US008347912B2

(12) United States Patent
Szuster et al.

(10) Patent No.: US 8,347,912 B2
(45) Date of Patent: Jan. 8, 2013

(54) WASTE WATER PUMPING DEVICE

(76) Inventors: Miroslaw Szuster, Biala (PL); Rafal Wojciechowski, Koszalin (PL)

( * ) Notice: Subject to any disclaimer, the term of this patent is extended or adjusted under 35 U.S.C. 154(b) by 636 days.

(21) Appl. No.: 12/225,392

(22) PCT Filed: Mar. 22, 2007

(86) PCT No.: PCT/PL2007/000014

§ 371 (c)(1),
(2), (4) Date: Oct. 19, 2009

(87) PCT Pub. No.: WO2007/108711

PCT Pub. Date: Sep. 27, 2007

(65) Prior Publication Data

US 2010/0224271 A1 Sep. 9, 2010

(30) Foreign Application Priority Data

Mar. 22, 2006 (PL) ..... P-379265
Mar. 22, 2007 (PL) ..... P-382032

(51) Int. Cl.
*B01D 47/00* (2006.01)
*B65D 88/64* (2006.01)
*E03B 5/00* (2006.01)

(52) U.S. Cl. ..... 137/565.17; 137/572; 417/36

(58) Field of Classification Search ..... 417/36, 417/423.3, 423.14; 137/236, 565.17, 571, 137/572

See application file for complete search history.

(56) References Cited

U.S. PATENT DOCUMENTS

| | | | | |
|---|---|---|---|---|
| 1,594,483 | A | 8/1926 | Yeomans | |
| 3,461,803 | A * | 8/1969 | Johnson et al. | 417/36 |
| 4,049,013 | A * | 9/1977 | Shenk | 137/263 |
| 4,209,034 | A | 6/1980 | Harald | |
| 4,693,271 | A * | 9/1987 | Hargrove et al. | 137/565.17 |
| 4,758,133 | A * | 7/1988 | Clark et al. | 417/360 |
| 4,900,438 | A * | 2/1990 | McEwen | 210/236 |
| 5,030,346 | A * | 7/1991 | McEwen | 210/258 |

FOREIGN PATENT DOCUMENTS

| | | |
|---|---|---|
| FR | 2578000 A1 | 8/1986 |
| FR | 2822484 A1 | 9/2002 |

* cited by examiner

*Primary Examiner* — Peter J Bertheaud
(74) *Attorney, Agent, or Firm* — Gary J. Gershik; Cooper & Dunham LLP

(57) ABSTRACT

In the device, according to the invention, the retention tank (7) constitutes a distributing chamber which is connected to the external retention tank (10) being a segment of a gravity-flow channel (11) with its cross-section greater than the cross-section of gravity waste water transfer required in the calculations, located on the line of waste water inflow to the retention tank (7), whereas the capacity of the retention tank (7) is at least two times smaller than the capacity of the external retention tank (10) constituting a segment of the gravity-flow channel (11) with its cross-section greater than the required cross-section of the gravity-flow channel (11) for gravity waste water transfer required in the calculations.

15 Claims, 8 Drawing Sheets

WASTE WATER PUMPING DEVICE

This application is a '371 national stage entry of PCT International Application No. PCT/PL2007/000014, filed Mar. 22, 2007, claiming priority of Polish Applications Nos. P-382032, filed Mar. 22, 2007, and P-379265, filed Mar. 22, 2006, the entire contents of each of which are hereby incorporated by reference.

FIELD OF THE INVENTION

The invented object, a waste water pumping device, dedicated mainly for fecal waste water pumping installations. Besides, it can be applied in other pumping systems and its solutions can be used for modernization of the already existing waste water tank pumping stations.

BACKGROUND OF THE INVENTION

The classical waste water tank pumping stations employing immersed sewage pumps fixed automatically on a coupling footings immersed in the waste water pumped by them. The pumping station tanks in the developed versions have most commonly beds in a form of cone or sphere, which improves to some extent the hygienic conditions in the pumping stations. Furthermore, they can be equipped with devices controlling the pump performance aiming at elimination of floating rubbish which in turn reduces the water level at the inlet of the immersed pump, and with automatic rinsing valves supporting the pump performance in terms of elimination bed sediments. In such waste water pumping stations the retention share of waste water is contained in the same tank as the immersed pump and the staff has a more direct reach to the waste water upon each entrance to such a tank. This tank is called a wet tank or a wet chamber.

Nevertheless, the conditions of service and operation in such developed pumping stations have not improved noticeably, while their production costs have risen significantly.

Pumping devices placed in dry tanks are more commonly known and used. These include both the waste water pumping devices employing impeller pumps and also air compressors. In comparison to tank pumping stations they provide virtual airtight sealing of the object and its operation can be performed in much cleaner environment In such pumping systems, the retention share of the waste water is contained in a separate retention tank located most frequently on the bed of the dry tank or next to the dry tank, so that the staff does not have the direct contact with the sewage water each time upon entering such a tank. This tank is also called a dry chamber. In case when the dry chamber is located in flooded areas and there is a possibility of its flooding, the hermetic impeller pumps with engine cooled by the passing liquid or immersed impeller pumps adjusted also to dry outdoor operation. Manual pumps or portable immersed pumps are used for the purpose of emptying the waste water overflowed from the retention tank during pump replacement or system inspection.

The main disadvantage of this solution is the difficult operation of tightly packed vertical tanks, pumps and fittings, as well as too deep pump casing in relation to the level of the waste water channel inlet, which significantly rises the costs of production of new waste water pumping devices.

The increasingly higher regulations in terms of environment protection, reliability of pumping systems performance, reduced purchase and maintenance costs influence the attitudes in the branch of water management and waste water disposal towards these problems and thus are a stimulus for the search of new solutions for waste water pumping stations, especially containing solid particles.

Due to this, the expectations of the water management and waste water disposal companies supported by increasingly strict regulations with regard to environment protection in residential areas, human presence near to sewage plants and provision of possibly hygienic conditions for their operation aim towards elimination of unpleasant and dangerous odours, for example by tightening of the sewage systems and their improved performance and reliability.

Therefore, the above factors, among them especially reduction of labour in the waste water environment should be primarily considered with regard to specific solutions of the modern pumping stations.

Thus, it has become necessary to construct such a pumping device which would meet the expectations of the water management and waste water disposal companies, as well as fulfil the strict regulations with regard to environment protection in residential areas and human presence near to waste water treatment facilities and possibly best hygiene for their operation.

BRIEF SUMMARY OF THE INVENTION

The above requirements can be fulfilled by a pumping waste water device located in the by a waste water pumping device placed in the dry tank in form of a manhole well in which the retention part is located in at least one tight retention tank, while the device itself is user-friendly and it does not generate any problems caused by sedimentation of solid particles on the bed or the waste water surface in the retention section, whereas its total cost is approximately equal or smaller than the total cost of improved tank pumping stations.

DETAILED DESCRIPTION OF THE INVENTION

Figure 1:
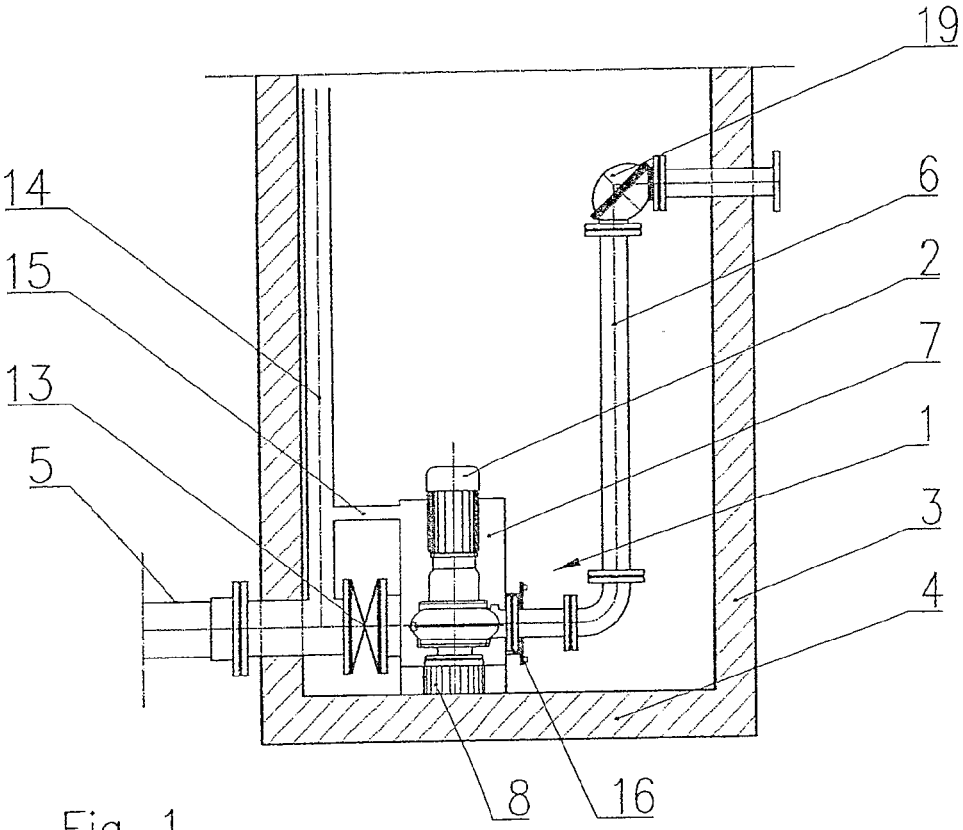
FIG. 1: is a side view diagram of the waste water pumping device of the present invention, in a first variant.

In the device according to the invention, the retention tank constitutes a distributing chamber which is connected to the external retention tank being a segment of a gravity-flow channel with its cross-section greater than the cross-section of gravity waste water transfer required in the calculations, located on the line of waste water inflow to the retention tank, whereas the capacity of the retention tank is at least two times smaller than the capacity of the external retention tank constituting a segment of the of the gravity-flow channel with its cross-section greater than the required cross-section of the gravity-flow channel for gravity waste water transfer required in the calculations.

The capacity of the retention tank is to the best advantage three to fifteen times smaller than the capacity of the external retention tank.

The operational capacity of the retention tank is to the best advantage four to twenty times smaller than the capacity of the external retention tank.

In the first of the beneficial structure, the retention tank is made in a form of a rectangular prism with at least one suction channel conducted from its bottom section, constituting a uniform structure with the retention tank, to which the impeller pump inlet resting on the suction channel is connected.

As a variant, by using a pneumatic positive-displacement pump, the retention tank is made in form of a rectangular prism with at least one suction channel conducted from its bottom section to which the inlet of the operating tank of the pneumatic positive-displacement pump is connected.

In the second advantageous structure, by using a pneumatic positive-displacement pump, the retention tank is made in a form of a vertically positioned cylinder with at least one suction channel conducted from its bottom section in a form of a base elbow to which the inlet of the impeller pump resting on this elbow is connected, and the whole structure is fixed to the frame.

As a second variant, by using a pneumatic positive-displacement pump, the retention tank is made in form of a vertically positioned cylinder with at least one suction channel conducted from its bottom section to which the inlet of the operating tank of the pneumatic positive-displacement pump is connected.

In order to provide proper air venting of the retention tank the from the gravity-flow pipe located inside the dry tank the main venting pipe is conducted and connected to the retention tank in its upper section with its lateral venting conduit.

For comfortable performance of retention tank inspection and dismantling, as well as installation of a impeller pump on the gravity-flow pipe, between the main venting pipe and the retention tank, a gate is installed, and the retention tank has a tightly closed inspection hole located in its upper section or aside, on the axis of the gravity-flow pipe. For the purpose of appropriate performance control of at least one impeller pump, the retention tank has a control unit fixed to its upper section or aside which controls the operation of at least one impeller pump or the operating tank of the pneumatic positive-displacement pump, depending on the waste water level In the retention tank.

To the best advantage, on the pressure pipe an isolating organ and an elbow-shaped valve or a non-return elbow-shaped valve integrated with a blade gate is installed.

For inspection purposes of the external retention tank, on the gravity-flow channel before the retention tank, a cascade inspection chamber is installed whose inlet hole is located above its outlet hole.

As a variant, by using a pneumatic positive-displacement pump, between the retention tank, on at least one suction channel of the pneumatic positive-displacement pump, a non-return inflow valve is installed.

As an undoubted advantage of the hereinabove invention, the retention section is divided into two tanks, out of which the smaller retention tank, as a distributing chamber, is located inside the dry tank, and the greater external retention tank being a segment of the gravity-flow channel, whose cross-section is greater than the cross-section for gravity-flow waste water transfer required in calculations. As an additional advantage, the total retention capacity can be in this way adjusted by shortening or extending the external pipe retention tank already at the construction site. This can be of significant importance, when the estimations regarding waste water inflow of the tank have been modified and/or the pumps have been replaced by other models with different performance parameters. It is possible also due to the fact that such a tank is not a building but an element of a waste water channel.

Figure 2:
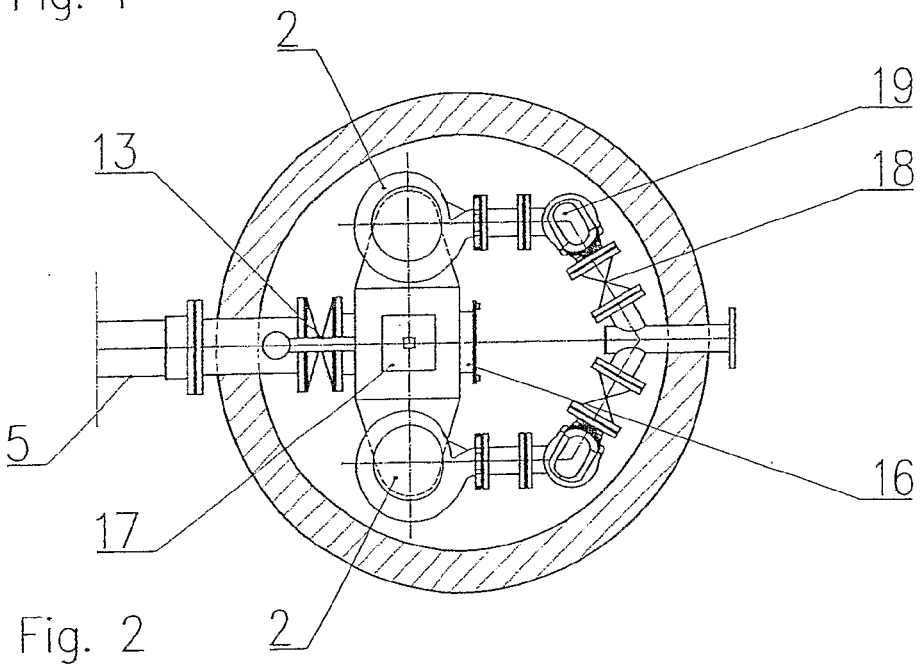
FIG. 2: is an overview diagram of the wastewater pumping device from FIG. 1.
Figure 3:
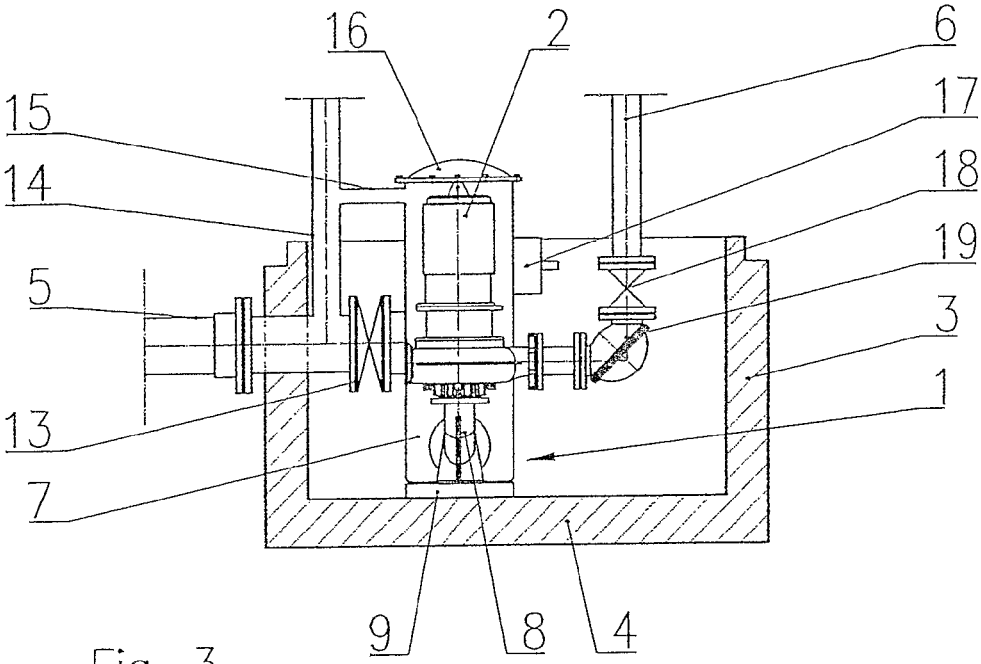
FIG. 3: is a side view diagram of the waste water pumping device of the present invention, in a second variant.
Figure 4:
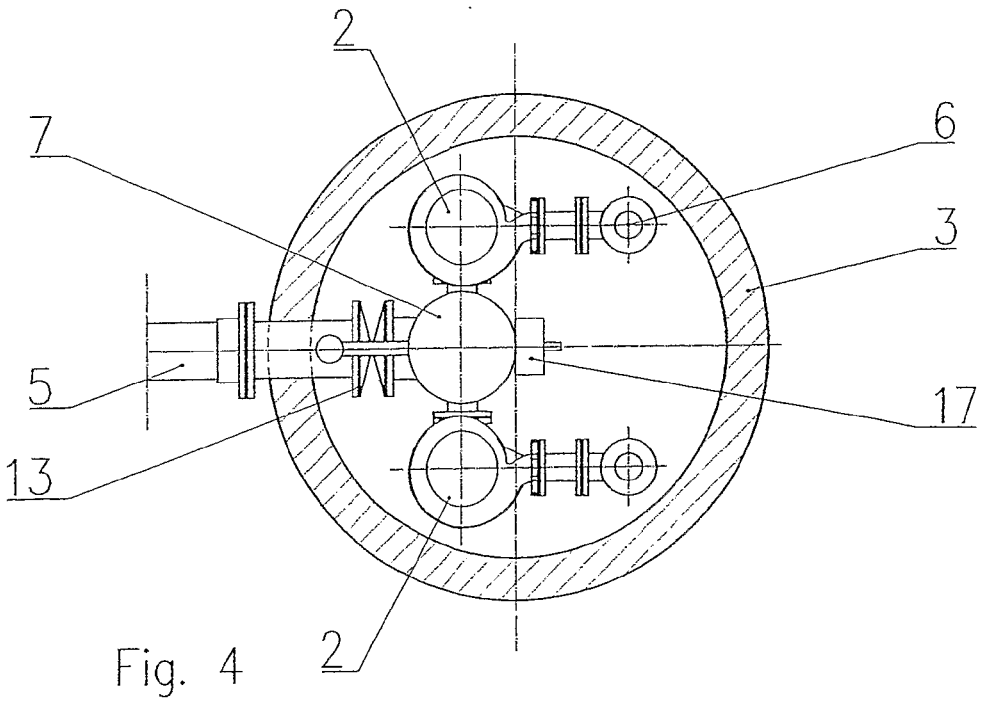
FIG. 4: is an overview of the waste water pumping device from FIG. 3.
Figure 5:
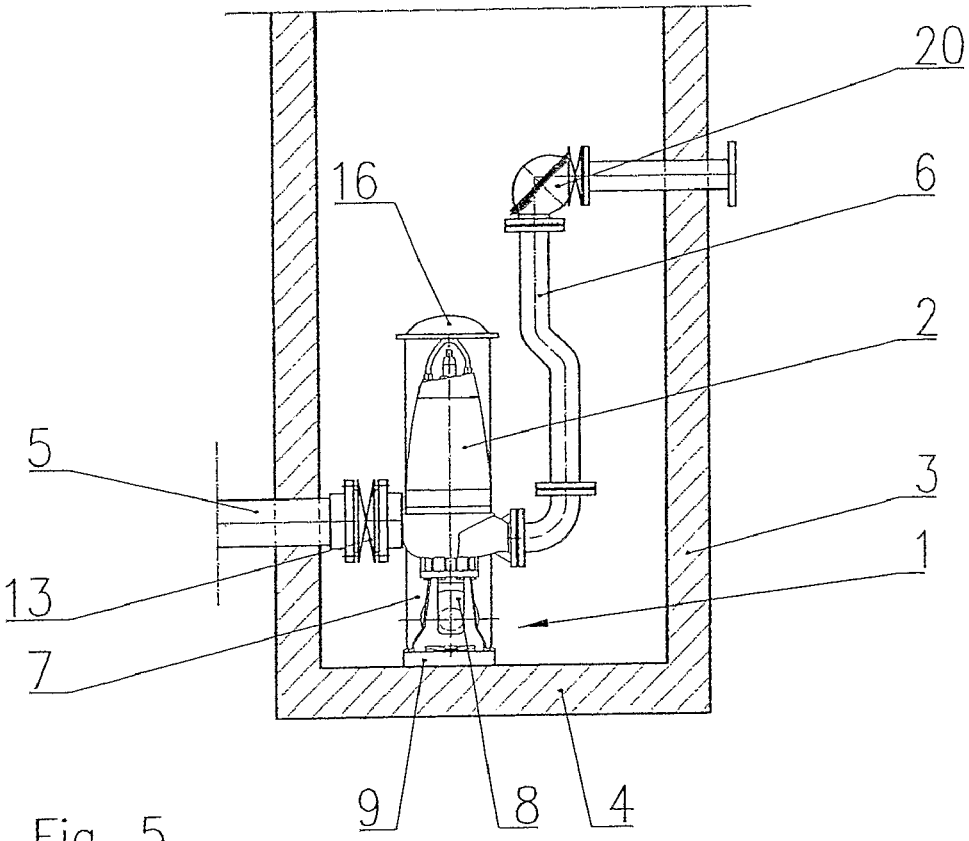
FIG. 5: is a side view diagram of the waste water pumping device of the present invention, in a third variant.
Figure 6:
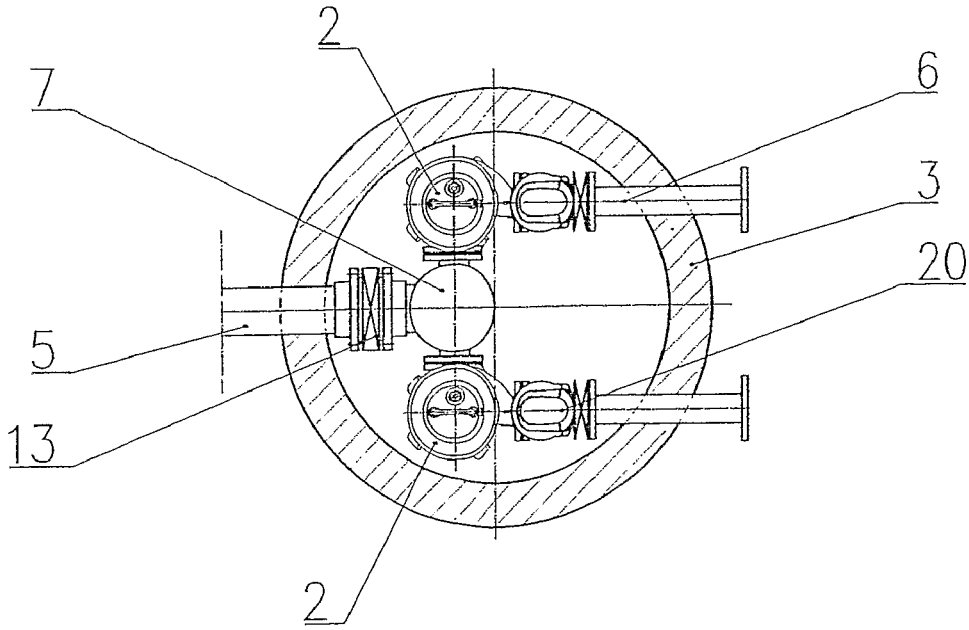
FIG. 6: is an overview diagram of the waste water pumping device from FIG. 5.
Figure 7:
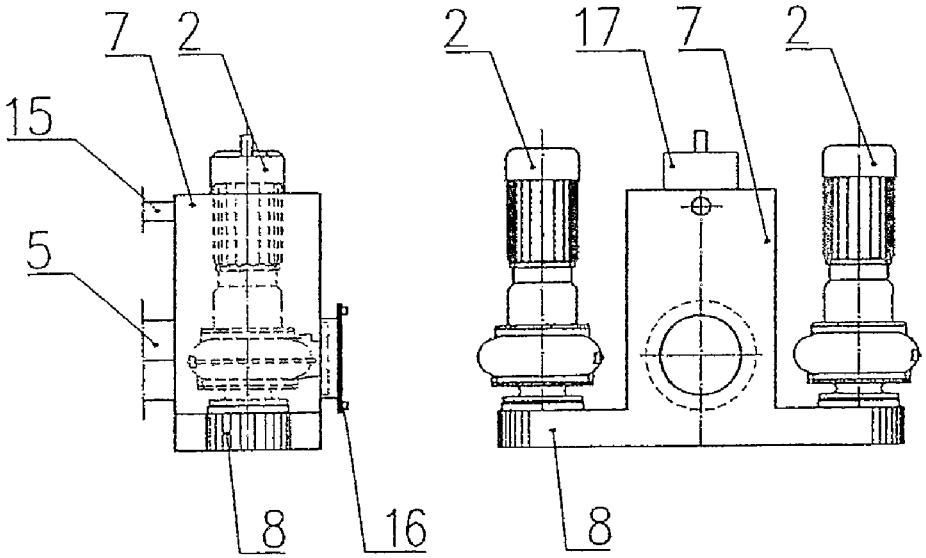
FIG. 7: is another side view diagram of the waste water pumping device of the first variant.
Figure 8:
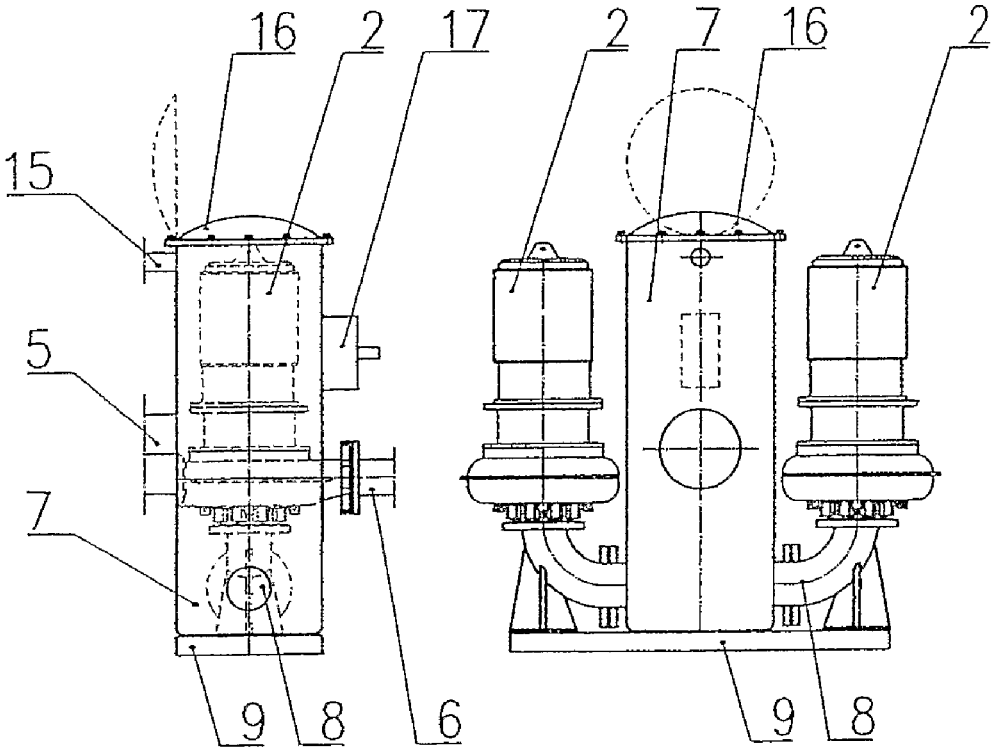
FIG. 8: is another side view diagram of the ter pumping device of the second variant.
Figure 9:
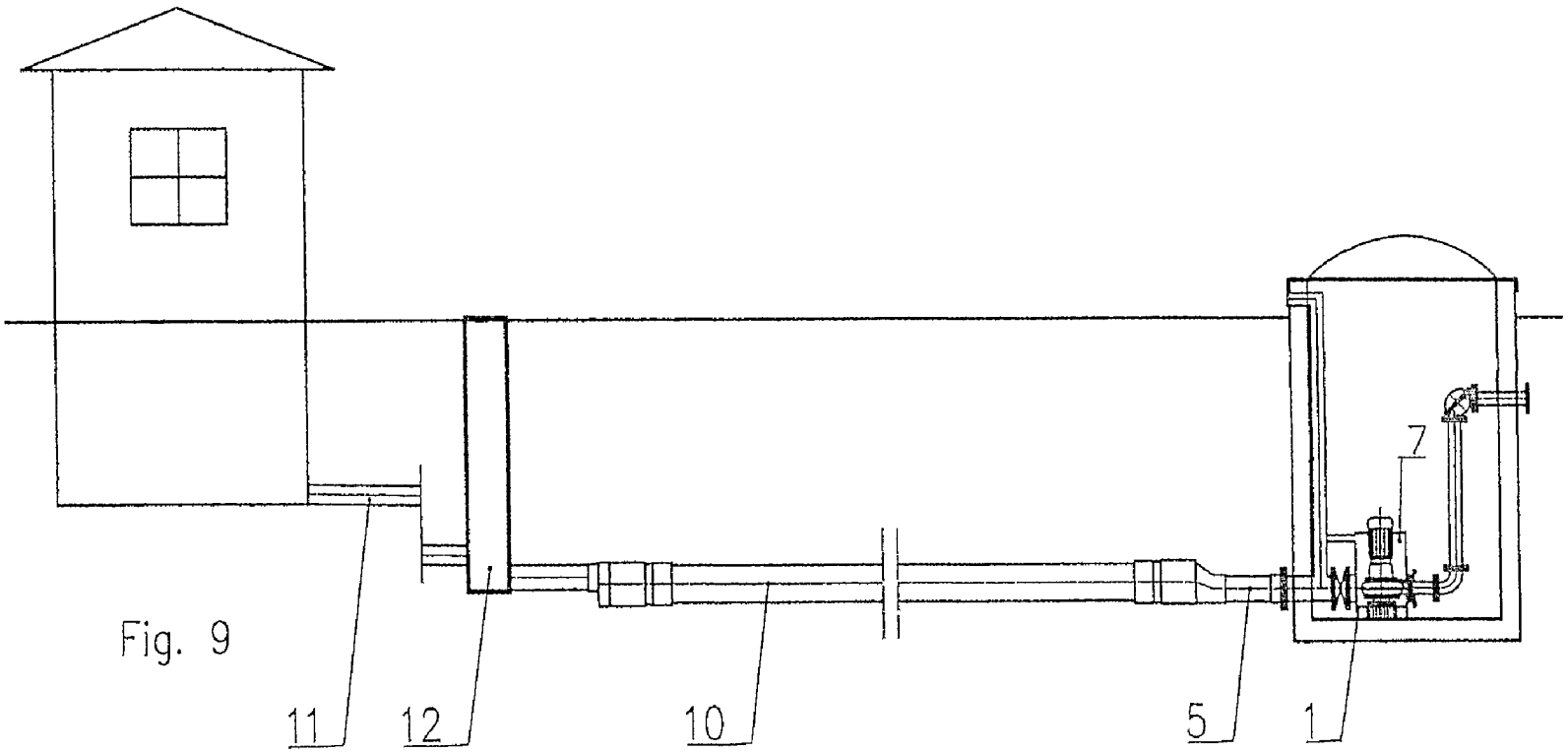
FIG. 9: is a side view diagram of the waste water pumping device of the first variant together with an external retention tank.
Figure 10:
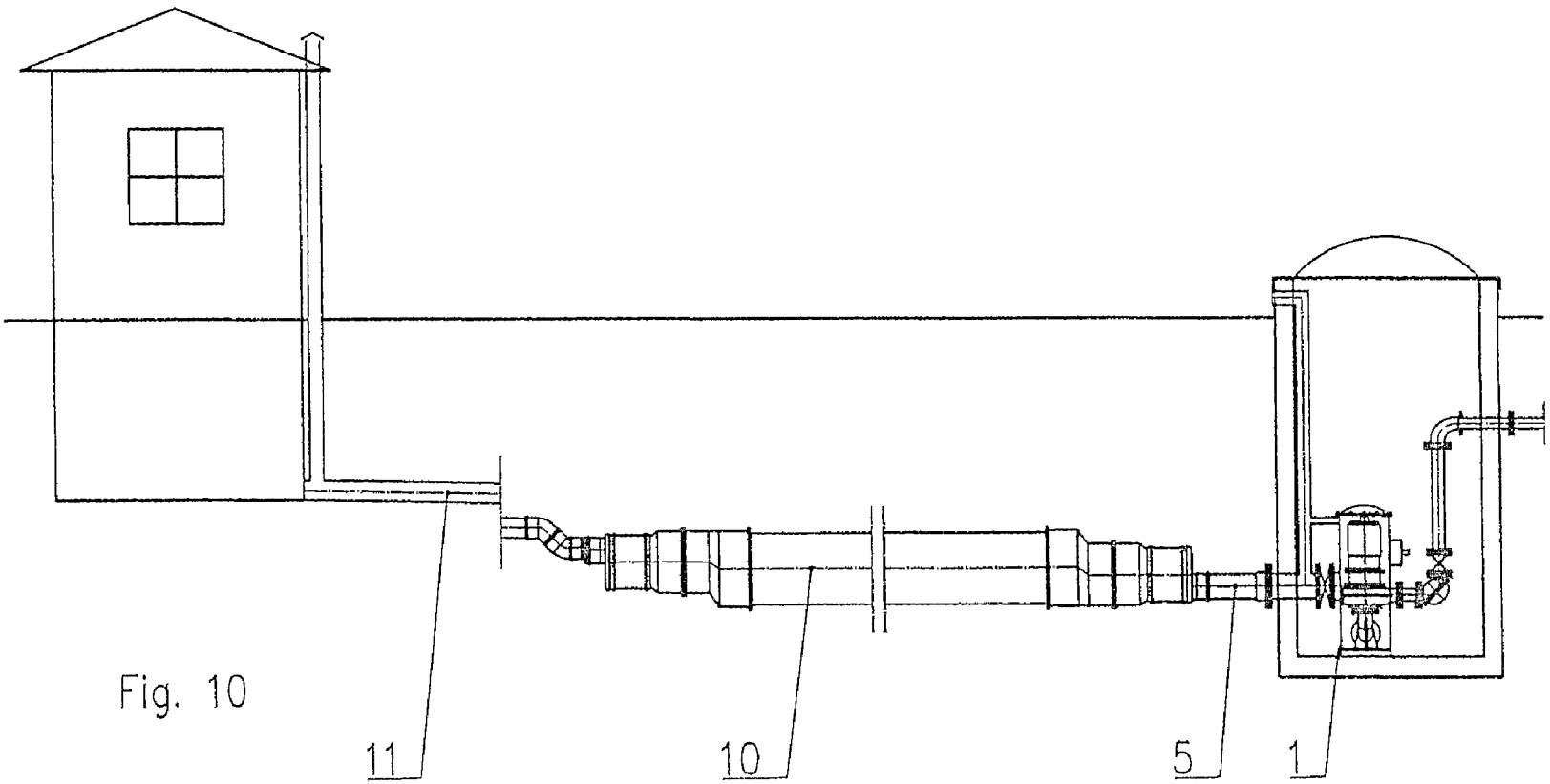
FIG. 10: is a side view diagram of the waste water pumping device of the second variant together with an external retention tank.
Figure 11:
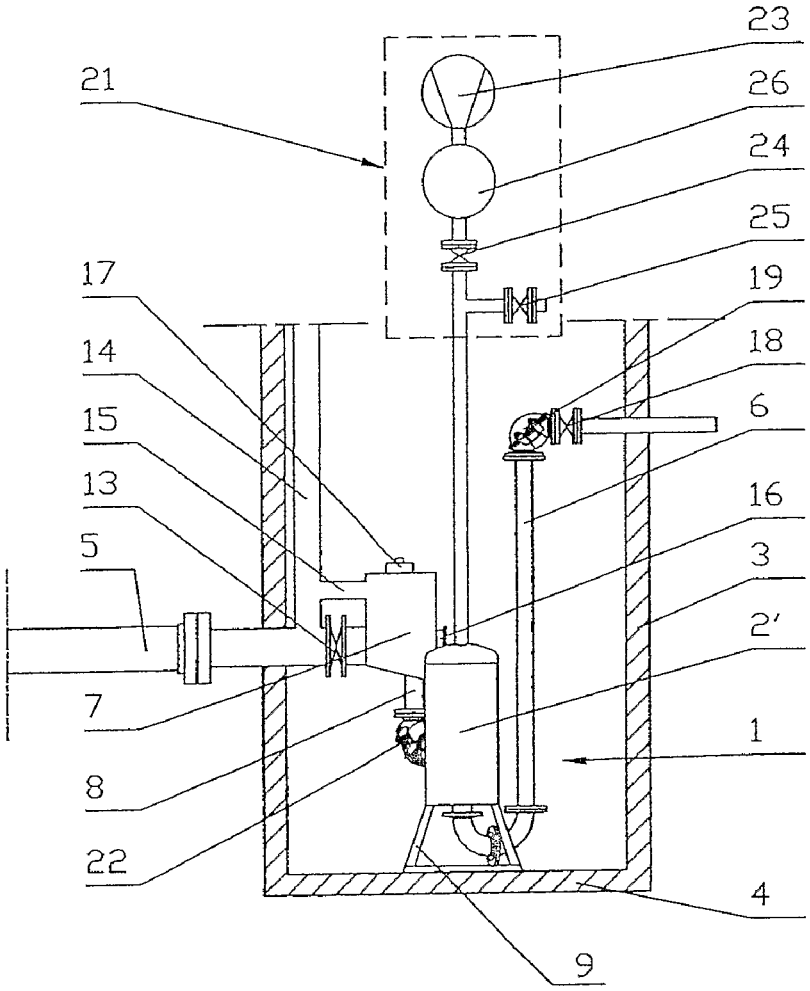
FIG. 11: is side view diagram of an alternative waste water pumping device in the first variant.
Figure 12:
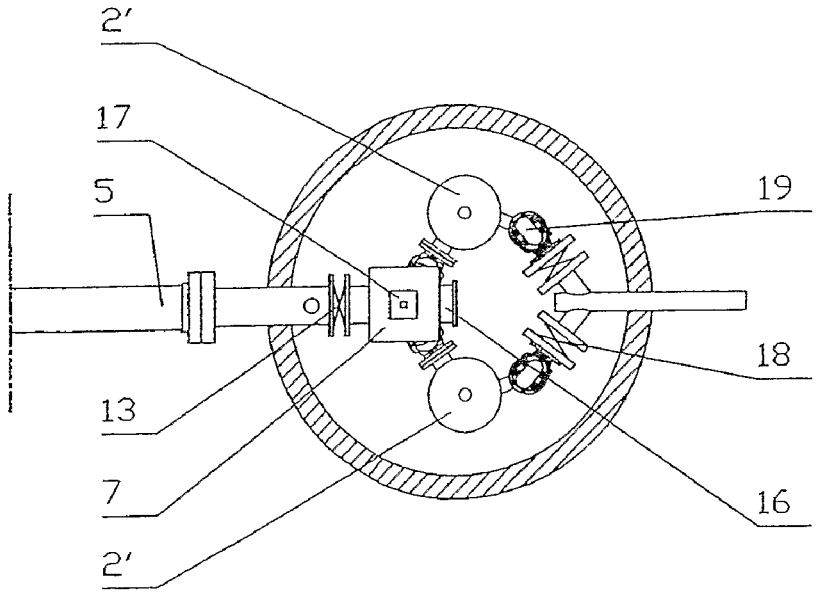
FIG. 12: is an overview diagram of the waste water pumping device of FIG. 11.
Figure 13:
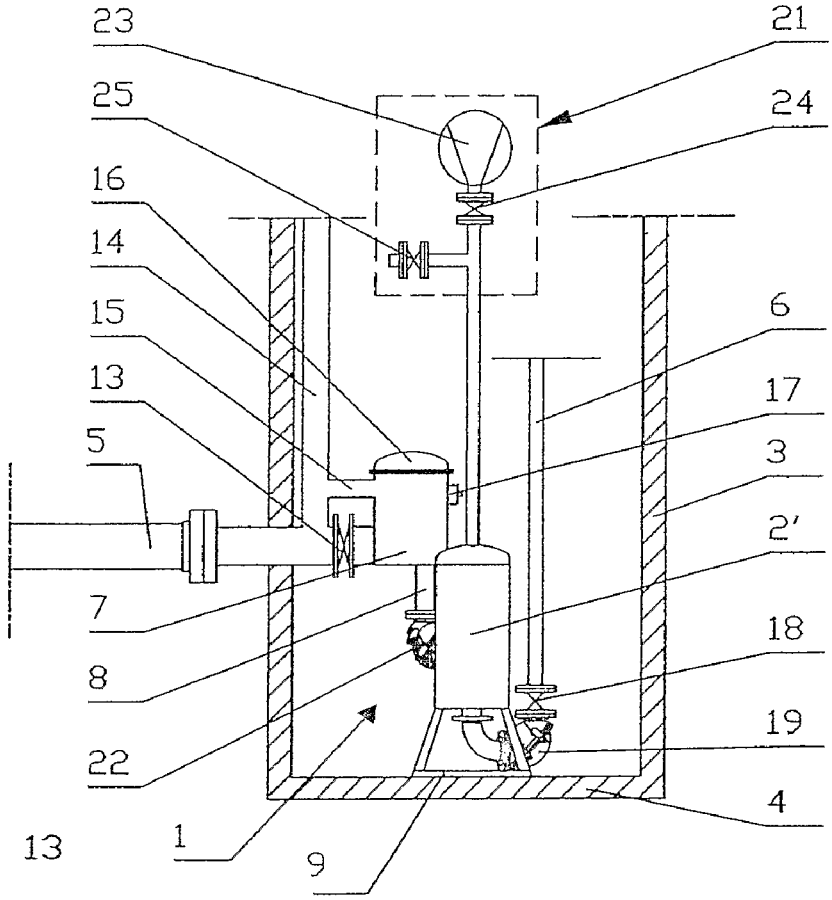
FIG. 13: is side view diagram of an alternative waste water pumping device in the second variant.
Figure 14:
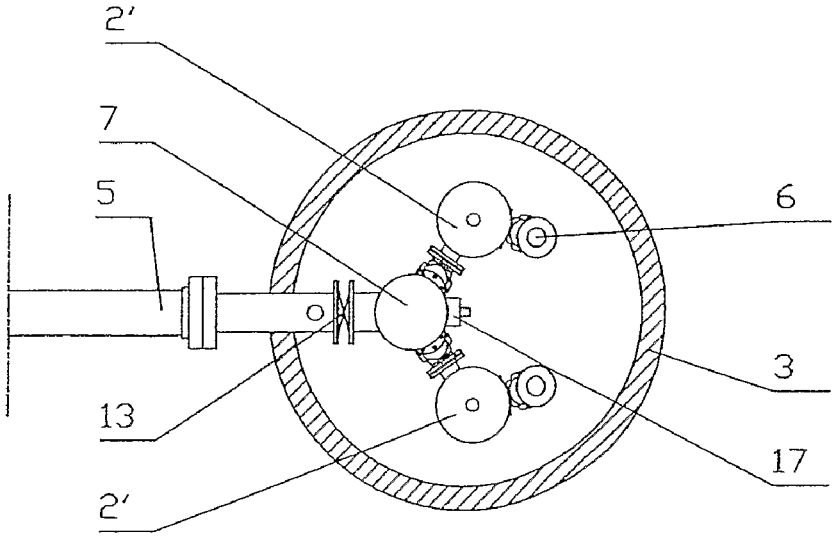
FIG. 14: is an overview diagram of the waste water pumping device of FIG. 13.

The invented objected is described in detail in the construction examples presented in figures, where FIG. 1 is a pumping device diagram in a side view, in the first variant, FIG. 2 is an overview of the waste water pumping device from FIG. 1, FIG. 3 presents a waste water pumping device side view, in the second variant, FIG. 4 presents an overview of the waste water pumping device from FIG. 3, whereas FIG. 5 shows a side view of the waste water pumping device diagram, in the third variant, FIG. 6 presents an overview of the waste water pumping device from FIG. 5, and furthermore, FIG. 7 and FIG. 8 present diagrammatically the same waste water pumping device from the first and second variant in two side views, and FIG. 9 and FIG. 10 presents diagrammatically the waste water pumping device from the first and second variant respectively, together with the external retention tank in a side view, FIG. 11 and FIG. 13 present diagrammatically the side views of variants of waste water pumping devices shown in FIG. 1 and FIG. 3, FIG. 12 and FIG. 14 present an overview of waste water pumping devices from FIG. 11 and FIG. 13.

The waste water pumping device 1 presented in FIG. 1 and FIG. 2 has two impeller pumps 2 with air-cooled engines and it is installed in a dry tank 3 as a manhole chamber with a flat bed 4. Waste water inflow is provided by an gravity-flow pipe 5 connected to the waste water pumping device 1 and the outlet is provided by a pressure pipe 6. Furthermore, the waste water pumping device 1 has a retention tank 7 in form of a rectangular prism connected to with the waste water inflow by a gravity-flow pipe 5 from which, in its bottom section, two suction channels are conducted constituting a uniform structure with the retention tank 7 to which the inlets of impeller pumps 2, resting on these channels are connected. On the pressure outlets of the impeller pumps 2, pressure pipes 6 are connected which transfer the waste water from the retention tank 7.

The waste water pumping device 1 presented in FIG. 3 and FIG. 5 in its second variant has a waste water retention tank 7 made in form of a vertically positioned cylinder together with two suction channels 8 conducted from its bottom section in form of a base elbow, and the entire structure is fixed to a frame 9. In FIG. 5 and fig. in the third variant, a waste water pumping device 1 has been presented, as in FIG. 3 and FIG. 4, apart from the fact that the engines of the impeller pumps 2 are not coo fed with the pumped liquid but are delivered as dry immersed pumps operating in air environment, whereas the pressure pipes 6 have S-bends enabling tight compaction of the waste water pumping device 1 structure on the small bed surface of the manhole chamber 4.

Consequently, FIG. 7 and FIG. 8 present diagrammatically the waste water pumping devices from the first and second variant themselves in two side views, ready for installation in a dry tank 3 in form of an integral manhole camber or consisting of separate components.

FIG. 9 presents diagrammatically the waste water pumping device 1 from the first variant together with the external retention tank 10 constituting a segment of the gravity-flow channel 11 in a side view, whereas on the gravity-flow channel 11, before the inlet of the external retention tank 10, a cascade inspection chamber 12 is located. The inlet of the cascade inspection chamber 12 is situated higher than its outfit, whereas the diameter of the outlet hole is greater than the diameter of the inlet hole.

FIG. 10 presents diagrammatically the waste water pumping device 1 from the second variant together with an external retention tank 10 constituting a segment of the gravity-flow channel 11 in a side view, where as on the gravity-flow channel 11, before the inlet of the external retention tank 10 there is a fault of the gravity-flow channel 11 delivered in such a way that the outlet behind the gravity-flow channel 11 connected to the inlet of the external retention tank 10 is located lower than the gravity-flow channel 11. 80th the cascade chamber 12 and the fault of the gravity-flow channel 11 make for the full usage of the capacity of the external retention tank 10 without causing backwater or reversing of waste water in the gravity-flow channel 11.

In order to provide the possibility of impeller pump 2 replacement a gate 13 is installed on the gravity-flow pipe 5, inside the dry tank 3. From the gravity-flow pipe 5 located outside the dry tank 3 the main venting pipe 14 is conducted, connected to the retention tank 7 in its upper section with a lateral venting conduit 15, whereas the gate 13 is installed between the main venting pipe 14 and the retention tank 7. This provides proper venting of the retention tank and balancing of pressure in the tank and the gravity-flow pipe 5. The retention tank 7 has a tightly closed inspection hole 16 located in its upper section or aside, on the axis of the gravity-flow pipe 5.

The inlet of the gravity-flow channel 11 in the external retention tank 10 is located higher than the gravity-flow pipe 5 which provides full venting of the external retention tank 10 to the direction of its inlet.

Due to low capacity of the retention tank, the impeller pumps 2 do not necessarily need isolation between their inlet and the suction channel 8 in form of, for example, a blade gate. In case of disassembling such a pump from the suction channel 8, after previous closing of the gate 13, the open hole can be plugged with a full flange and after opening the gate 13 start only one pump.

The performance of the waste water pumping device 1 does not practically differ from the performance of other pumping devices of this type, apart from the fact that the pump performance control applies only to the retention tank 7 and the external tank 10 is used exclusively for accumulation of the waste water deliver via the gravity-flow channel 11. Controlling performed by starting and stopping the impeller pumps 2 takes place by means of a control unit 17 reacting to the changes of the liquid surface level in the retention tank 7. The control unit 17 is installed in the upper or side section of the retention tank, whereas in order to limit the fluctuation of the waste water surface level in the retention tank 7, special deflectors (masks) can be used at the outlet of the gravity-flow pipe 5. In order to provide high performance reliability of the device 1 an isolating organ 18 and a non-return elbow-shaped valve 19 is installed on the pressure pipe, providing its full opening at minimum waste water flow speed. When there is no space, a non-return elbow-shaped valve integrated with a blade gate 20 can be used.

FIG. 11, FIG. 12, FIG. 13 and FIG. 14 present the variants of waste water pumping devices 1 employing a pneumatic positive-displacement pump 21. For these variants, between the retention tank 7 on at least one suction channel 8 to which is connected the inlet of the operating tank 2' of the pneumatic positive-displacement pump 21, a non-return inflow valve is installed 22. The pneumatic positive-displacement pump 21 has an air compressor 23 and an isolating valve 24 which enables isolation of the pneumatic link between the mentioned air compressor and the operating tank 2', and a venting valve 25 located on the side junction of the pneumatic link enabling the venting of the operating tank 2'. This variant presented in FIG. 11 is additionally equipped with an air compressor tank 26 located on the fine of the pneumatic link between the air compressor 23 and the isolating valve 24.

The performance of the above variants of the waste water pumping device 1 by using the pneumatic positive-displacement pump 21 does not practically differ from the performance of other waste water pumping devices, apart from the fact that the performance control of a pneumatic positive-displacement pump 21 applies only to the retention tank 7, and the external retention tank 10 is used exclusively for accumulation of the waste water deliver via the gravity-flow channel 11. Controlling performed by starting and stopping takes place by means of a control unit 17 reacting to the changes of the liquid surface level in the retention tank 7. The control unit 17 is installed in the upper or side section of the retention tank, whereas in order to limit the fluctuation of the waste water surface level in the retention tank 7, special deflectors (masks) can be used at the outlet of the gravity-flow pipe 5. While the isolating valve 24 is closed and the venting vale is open 25 the waste water flow from the retention tank 7 via the suction channel 8 and the non-return inflow valve 22 they pass to the operating tank 2', where they are accumulated until complete filling. After a while, the control unit 17 closes the venting valve 25 and opens the isolating valve 24, whereupon the compressed air pushes the waste water from the operating tank 2' through the non-return elbow-shaped valve 19 and the pressure pipe 6, at the same time automatically closing the operating non-return inflow valve 22 which normally is open. After emptying of the operation tank 7, the control unit 17 closes the isolating valve and opens the venting valve 25, as a result of which the non-return inflow valve 22 opens automatically, enabling waste water inflow to the operating tank. These cycles are repeated alternately at a frequency dependant from the intensity of waste water inflow. The air compressor is started each time the isolating valve 24 is open and the venting valve 25 is closed, or when the pressure in the air compressor tank 26 falls below the operating pressure set in the control unit 17.

The figures do not present the specific solutions known from the state of the art, as for example control units with different features and operating principles.

The above variants do not exhaust all delivery and application variants of the device according to the invention, reserved by claims from 1 to 14.

The invention claimed is:

1. A waste water pumping device comprising:

i) a gravity flow channel having a cross-section calculated based on the amount of waste water to be transferred, and comprising an external retention tank in line with the flow of waste water positioned at a downstream portion of the gravity flow channel, wherein the external retention tank has a cross-section greater than the cross-section of an upstream portion of the gravity flow channel; and ii) a dry tank having a gravity flow inlet pipe, which is connected to an outlet of the gravity flow channel, and a pressure flow outlet pipe, wherein the dry tank contains:

(a) a retention tank disposed on a bed of the dry tank and connected to the gravity flow inlet pipe, wherein the retention tank constitutes a distributing chamber for the external retention tank, and wherein the capacity of the retention tank is at least two times smaller than the capacity of the external retention tank;

(b) at least one pump connected to the pressure flow outlet pipe, wherein the pump is a pneumatic positive-displacement pump or an impeller pump; and (c) at least one suction channel connecting the retention tank and the at least one pump; wherein waste water flows from the external retention tank portion of the gravity flow channel to the retention tank, and, by way of the at least one suction channel, the at least one pump transfers waste water from the retention tank to the pressure flow outlet pipe.

2. The waste water pumping device of claim 1, wherein the capacity of the retention tank is three to fifteen times smaller than the capacity of the external retention tank.

3. The waste water pumping device of claim 1, wherein the capacity of the retention tank is four to twenty times smaller than the capacity of the external retention tank.

4. The waste water pumping device of claim 1, wherein the retention tank is a uniform structure in the form of a rectangular prism and having the at least one suction channel extended from a bottom section thereof which is connected to an inlet of an impeller pump which rests upon the at least one suction channel.

5. The waste water pumping device of claim 1, wherein the retention tank is in the form of a rectangular prism having the at least one suction channel extended from a bottom section thereof which is connected to an operating tank of a positive-displacement pump.

6. The waste water pumping device of claim 1, wherein the retention tank is in the form of a vertically positioned cylinder having the at least one suction channel extended from a bottom section thereof, wherein the at least one suction channel is in the form of a base elbow which is connected to an inlet of an impeller pump which rests upon the base elbow, and wherein the retention tank, at least one suction channel, and at least one pump are fixed to a frame.

7. The waste water pumping device of claim 1, wherein the retention tank is in the form of a vertically positioned cylinder having the at least one suction channel extended from a bottom section thereof, wherein the at least one suction channel is connected to an inlet of an operating tank of a positive-displacement pump.

8. The waste water pumping device of claim 1, further comprising a main venting pipe directly connected to the gravity flow inlet pipe and connected to an upper section of the retention tank by a lateral venting conduit.

9. The waste water pumping device of claim 8, wherein the gravity flow inlet pipe further comprises a gate between the retention tank and the main venting pipe.

10. The waste water pumping device of claim 1, wherein the retention tank has a tightly closed inspection hole located at a top or side of an upper section thereof on the axis of the gravity flow pipe.

11. The waste water pumping device of claim 1, wherein the retention tank has a control unit fixed to a top or side of an upper section thereof which controls the operation of at least one pump, depending on the waste water level in the retention tank.

12. The waste water pumping device of claim 1, wherein the pressure flow outlet pipe comprises an isolating organ and an elbow-shaped valve or a non-return elbow-shaped valve integrated with a blade gate.

13. The waste water pumping device of claim 1, wherein the gravity flow channel further comprises a cascade inspection chamber upstream from the external retention tank and having an inlet hole located above an outlet hole.

14. The waste water pumping device of claim 5, wherein the at least one suction channel connecting the retention tank and the at least one pump comprises a non-return inflow valve.

15. The waste water pumping device of claim 7, wherein the at least one suction channel connecting the retention tank and the at least one pump comprises a non-return inflow valve.

* * * * *